US007361055B2

(12) United States Patent
Fuerst

(10) Patent No.: US 7,361,055 B2
(45) Date of Patent: Apr. 22, 2008

(54) MODULAR FILTER CONNECTOR

(75) Inventor: Robert Fuerst, Rochester, MI (US)

(73) Assignee: Molex Incorporated, Lisle, IL (US)

( * ) Notice: Subject to any disclaimer, the term of this patent is extended or adjusted under 35 U.S.C. 154(b) by 674 days.

(21) Appl. No.: 11/035,525

(22) Filed: Jan. 14, 2005

(65) Prior Publication Data

US 2006/0157401 A1 Jul. 20, 2006

(51) Int. Cl.
*H01R 13/66* (2006.01)

(52) U.S. Cl. ..... 439/620.09

(58) Field of Classification Search ..... 439/620.09–620.14
See application file for complete search history.

(56) References Cited

U.S. PATENT DOCUMENTS 2,003,017 A * 5/1935 Smith ..... 191/1 R
5,018,989 A * 5/1991 Black et al. ..... 439/620.1
5,145,413 A * 9/1992 Okamoto et al. ..... 439/620.14
5,219,305 A * 6/1993 Kawaguchi et al. ... 439/620.12
5,286,221 A * 2/1994 Fencl et al. ..... 439/607
5,340,334 A * 8/1994 Nguyen ..... 439/620.12
5,599,208 A * 2/1997 Ward ..... 439/620.09
5,624,277 A * 4/1997 Ward ..... 439/620.09
5,647,768 A * 7/1997 Messuri et al. ..... 439/620.09
5,823,827 A * 10/1998 Belopolsky ..... 439/620.06
5,830,016 A * 11/1998 Chuang ..... 439/620.09
5,924,899 A * 7/1999 Paagman ..... 439/701
6,086,422 A * 7/2000 Glynn ..... 439/620.07
6,413,119 B1 * 7/2002 Gabrisko et al. ..... 439/620.1
6,467,165 B1 * 10/2002 Glynn ..... 29/876
6,478,626 B2 * 11/2002 Dingenotto et al. ... 439/620.14
6,652,292 B2 * 11/2003 Pratt et al. ..... 439/76.1
6,837,747 B1 * 1/2005 Kosmala ..... 439/620.09
2006/0009076 A1 * 1/2006 Yu ..... 439/620

* cited by examiner

*Primary Examiner*—Ross N. Gushi
(74) *Attorney, Agent, or Firm*—Larry I. Golden

(57) ABSTRACT

A modular filter connector (10) includes an outer housing (12) having a cavity. A plurality of inner housing modules (16) are positionable in the cavity in a side-by-side array. At least one terminal (28) is mounted in each housing module to define at least one row of terminals along the cavity. A filter (34) is mounted in each housing module electrically coupled to each terminal to define at least one row of filters. A common shorting bar (36) spans the plurality of housing modules and is electrically coupled to the plurality of filters of the modules.

21 Claims, 7 Drawing Sheets

MODULAR FILTER CONNECTOR

FIELD OF THE INVENTION

This invention generally relates to the art of electrical connectors and, particularly, to a modular filter connector which mounts a plurality of electronic components, such as capacitors or the like. The invention also relates to a method of fabricating the modular filter connector.

BACKGROUND OF THE INVENTION

There are a variety of electrical connectors which are termed "filter" connectors, in that an electronic component, such as a capacitor, is coupled between the terminals of the connector and a ground plate or shorting bar normally mounted to a face of a dielectric housing of the connector. The filters are used to suppress electromagnetic interference and radio frequency interference entering the connector system.

One of the problems with such filter connectors simply is their cost. Normally, a ground plate is fabricated of stamped and formed conductive metal material and must be mounted separately to the dielectric housing of the connector. Terminals then are mounted in the connector housing. The filter capacitors then must be coupled between the terminals and the ground plate or shorting bar. These steps are time consuming and require assembly tooling, all of which adds considerably to the cost of the connectors. In a mass production environment, reliability and performance often have much to be desired.

The present invention is directed to solving the above problems by providing a unique modular connector in which the terminals and filters/capacitors are mounted in modules and assembled in a larger outer connector housing. The outer housing can be easily molded in different sizes to customize the connector for receiving different numbers of modules. This is considerably less complicated and less expensive than customizing an entire connector for different numbers of terminals and filters.

SUMMARY OF THE INVENTION

An object, therefore, of the invention is to provide a new and improved, modular filter connector of the character described, along with a method of fabricating the connector.

In the exemplary embodiment of the invention, the connector includes an outer housing having a cavity. A plurality of inner housing modules are positionable in the cavity in a side-by-side array. At least one terminal is mounted in each housing module to define at least one row of terminals along the cavity. A filter is mounted in each housing module electrically coupled to each terminal to define at least one row of filters. A common shorting bar spans the plurality of housing modules and is electrically coupled to the plurality of filters of the modules.

According to one aspect of the invention, biasing means are provided between the shorting bar and the filters to bias the filters against the terminals. Preferably, the biasing means are integral with the shorting bar. In the preferred embodiment, the shorting bar is stamped and formed of sheet metal material, and the biasing means comprise integral leaf spring portions of the bar engageable with the filters.

According to another aspect of the invention, securing means are provided between adjacent housing modules to hold the modules in their side-by-side array. Preferably, the securing means comprises integral interconnecting means between adjacent housing modules, such as interengageable dovetail connections on the modules.

As disclosed herein, the terminals comprise terminal pins. The filters comprise capacitors. A plurality of the terminal pins are mounted in each housing module to define a plurality of generally parallel rows of terminals along the cavity. A corresponding plurality of generally parallel rows of the capacitors are respectively electrically coupled to the terminal pins. One of the common shorting bars is electrically coupled to the capacitors in each row thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
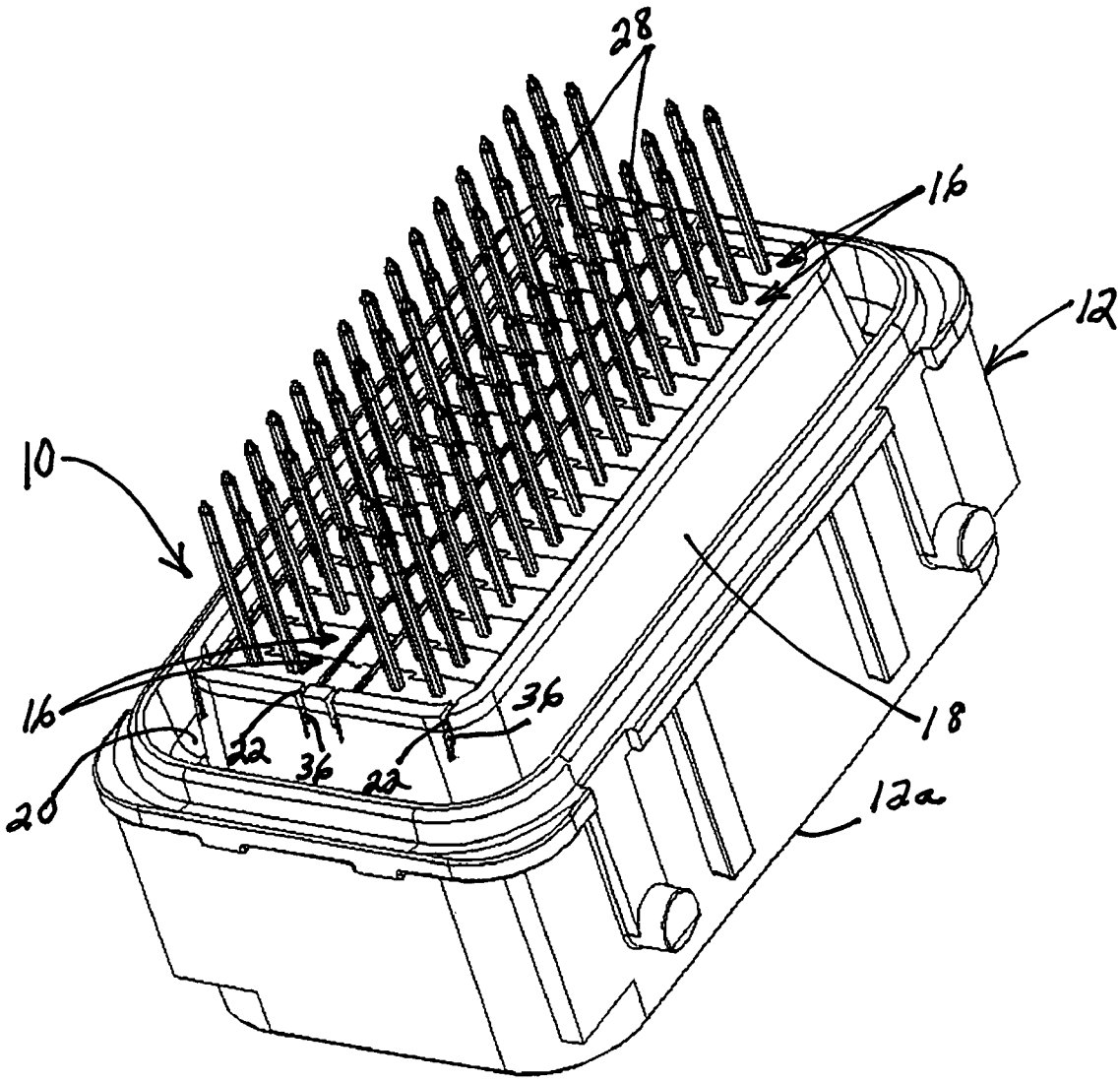
FIG. 1 is a perspective view of a modular filter connector embodying the concepts of the invention.
Figure 2:
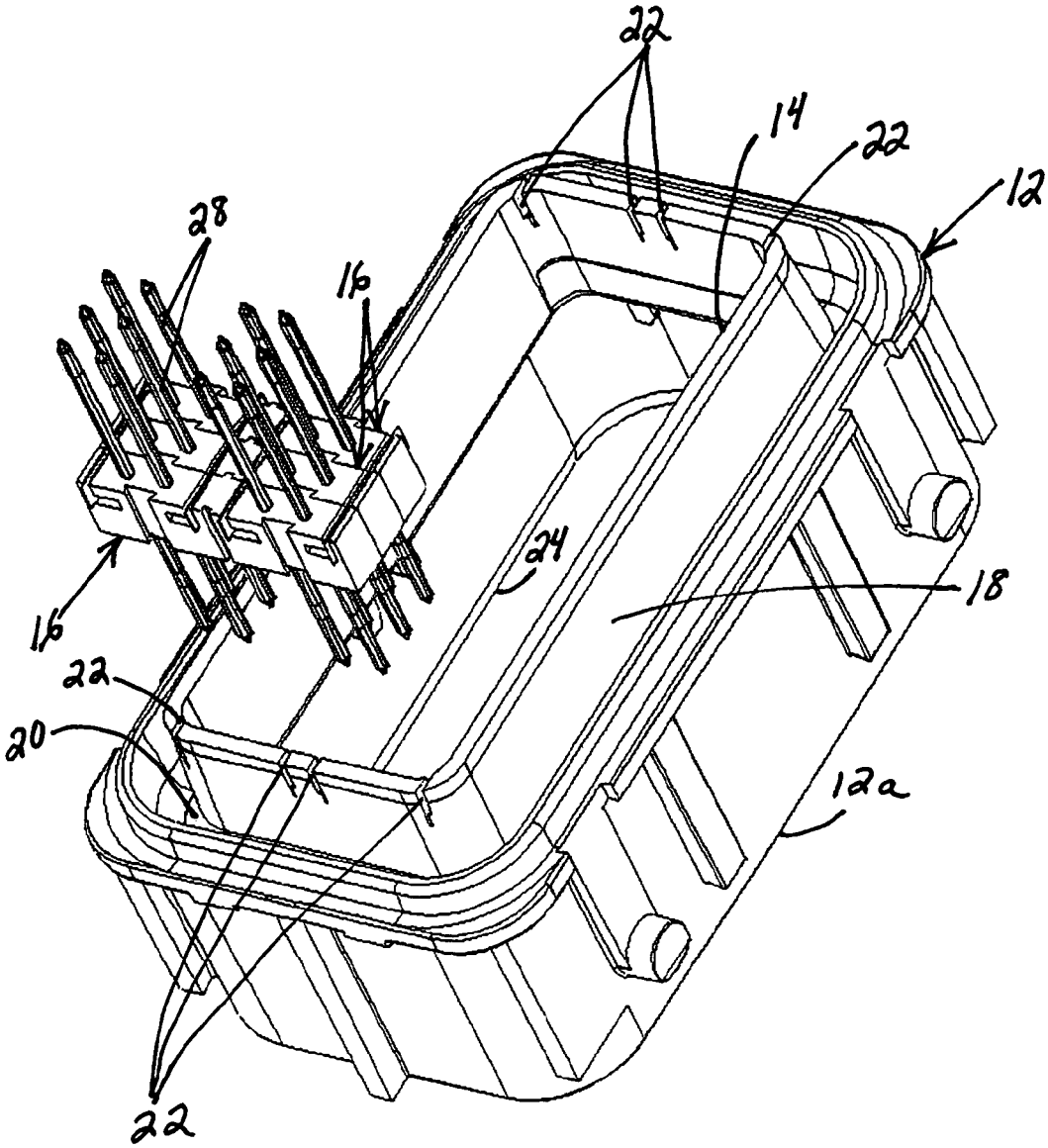
FIG. 2 is a perspective view of the outer connector housing, along with a cluster of three inner housing modules for illustration purposes.

Referring to the drawings in greater detail, and first to FIGS. 1 and 2, the invention is embodied in a modular filter connector, generally designated 10, which includes an outer connector housing, generally designated 12. The outer housing defines a cavity 14 which receives a plurality of inner housing modules, generally designated 16, which are positionable within the cavity in a side-by-side array as seen in FIG. 1.

More particularly, housing 12 is generally rectangular and includes a generally rectangular plug portion which surrounds and defines cavity 14. A peripheral groove 20 surrounds plug portion 18 for receiving a metal casing. Four slots 22 are formed in the outer edge of plug portion 18 at each opposite end thereof as best seen in FIG. 2, for receiving ends of four shorting bars as will be described hereinafter. Housing 12 has a mating end 12*a* which defines a receptacle 24 (FIG. 2) for receiving a complementary mating connecting device or second connector.

Figure 3:
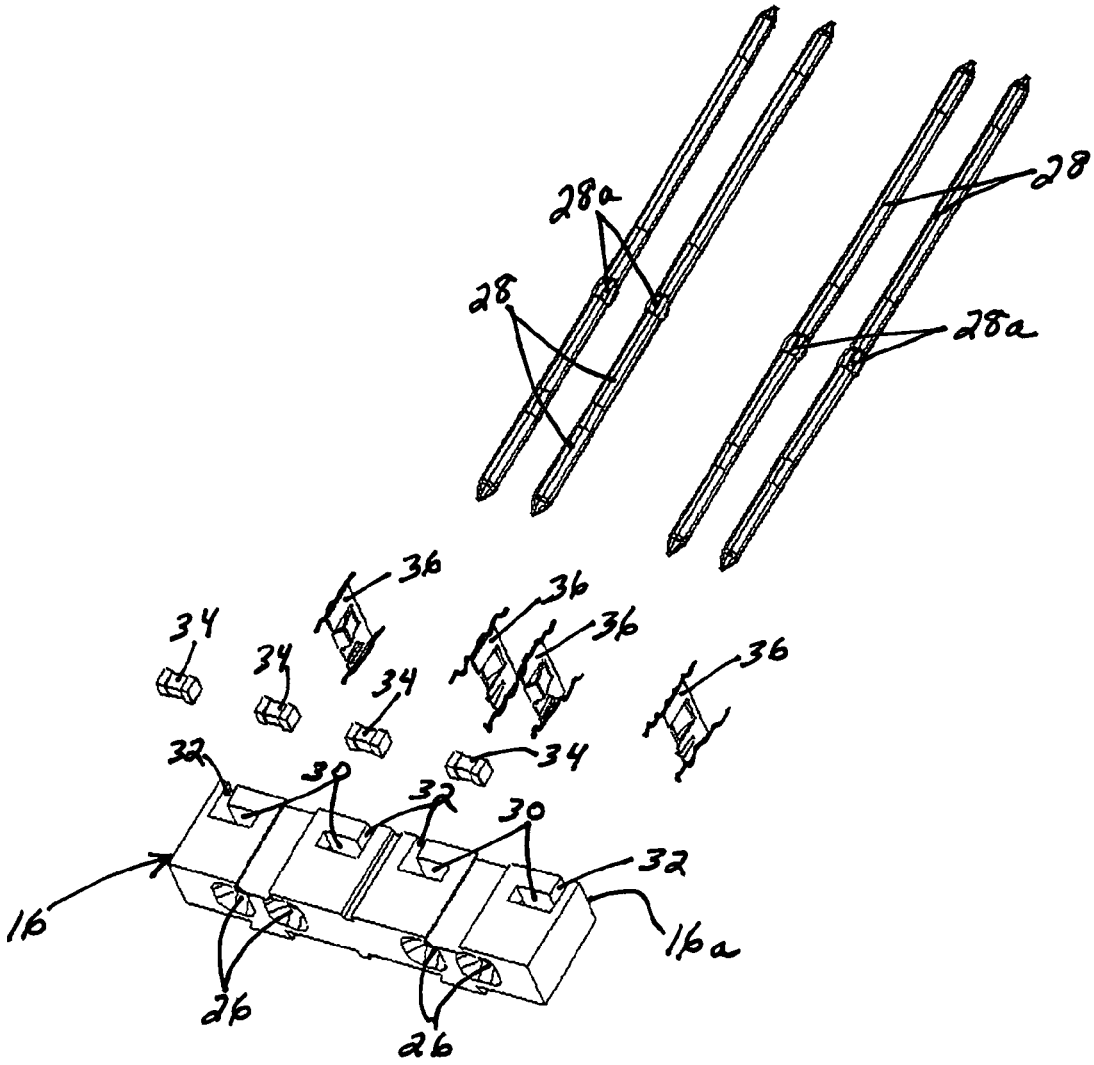
FIG. 3 is an exploded perspective view of one of the inner housing modules.
Figure 4:
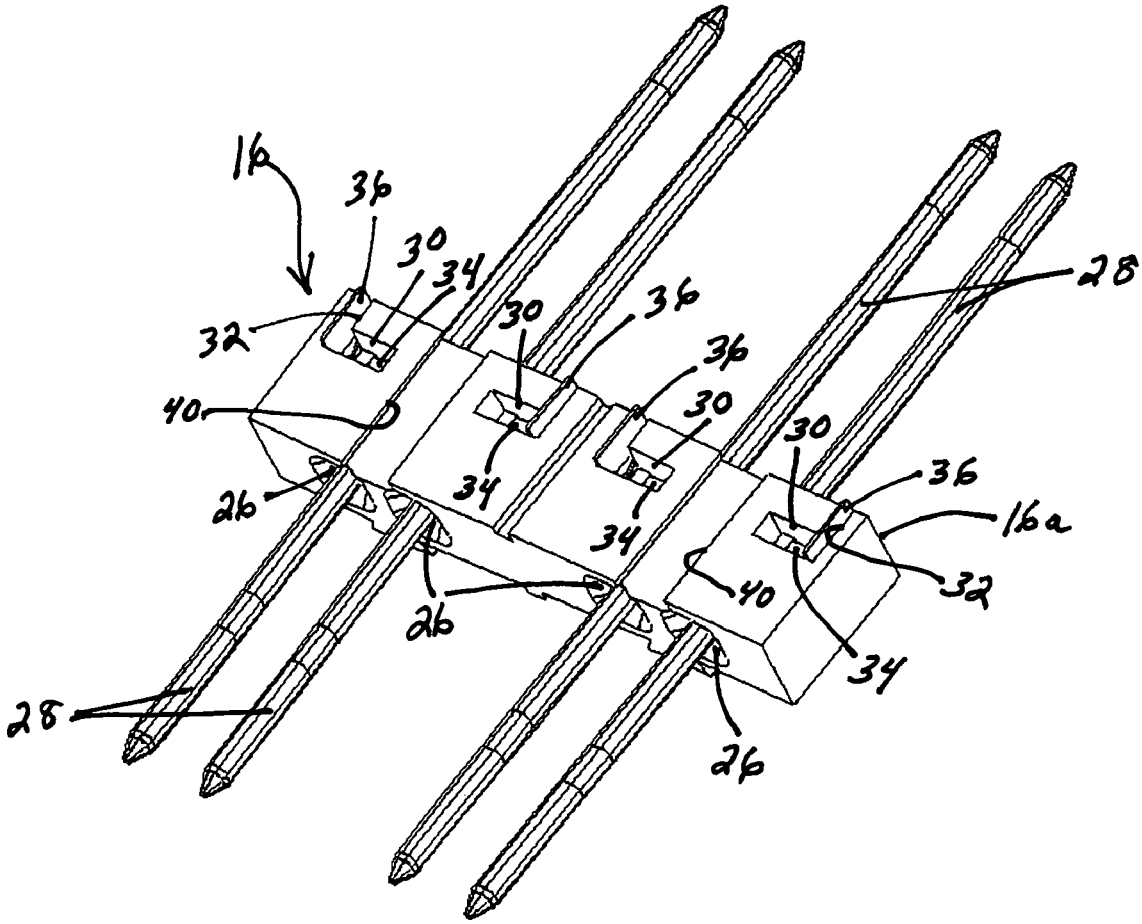
FIG. 4 is a perspective view of one of the inner housing modules in assembled condition.

Referring to FIGS. 3 and 4 in conjunction with FIGS. 1 and 2, each housing module 16 includes four terminal-receiving through passages 26 for receiving four terminal pins 28. The terminal pins are inserted through the housing module as seen in FIG. 4. Enlarged fixing sections 28*a* (FIG.

3) securely fix the terminal pins within passages 26. Each housing module is a one-piece structure that may be molded of dielectric plastic material.

Each inner housing module 16 also includes four pockets 30 formed in one side of the housing module, along with four slots 32 in a top face 16*a* of the module. Each pocket 30 communicates at one end thereof with a respective terminal-receiving passage 26. Each pocket also communicates at an opposite end thereof with a respective slot 32.

Four filters in the form of capacitors 34 are inserted into pockets 30 from the side of each housing module 16. When fully assembled, one end of each capacitor is electrically coupled or engaged with a respective one of the terminal pins 28, and an opposite end of the capacitor is electrically coupled or engaged with a shorting bar described below.

As seen best in FIG. 1, four common shorting bars span the entire side-by-side array of housing modules 16. In the depictions of FIGS. 2-4, only longitudinal or lengthwise sections of the shorting bars are shown simply to facilitate the illustration.

Figure 5:
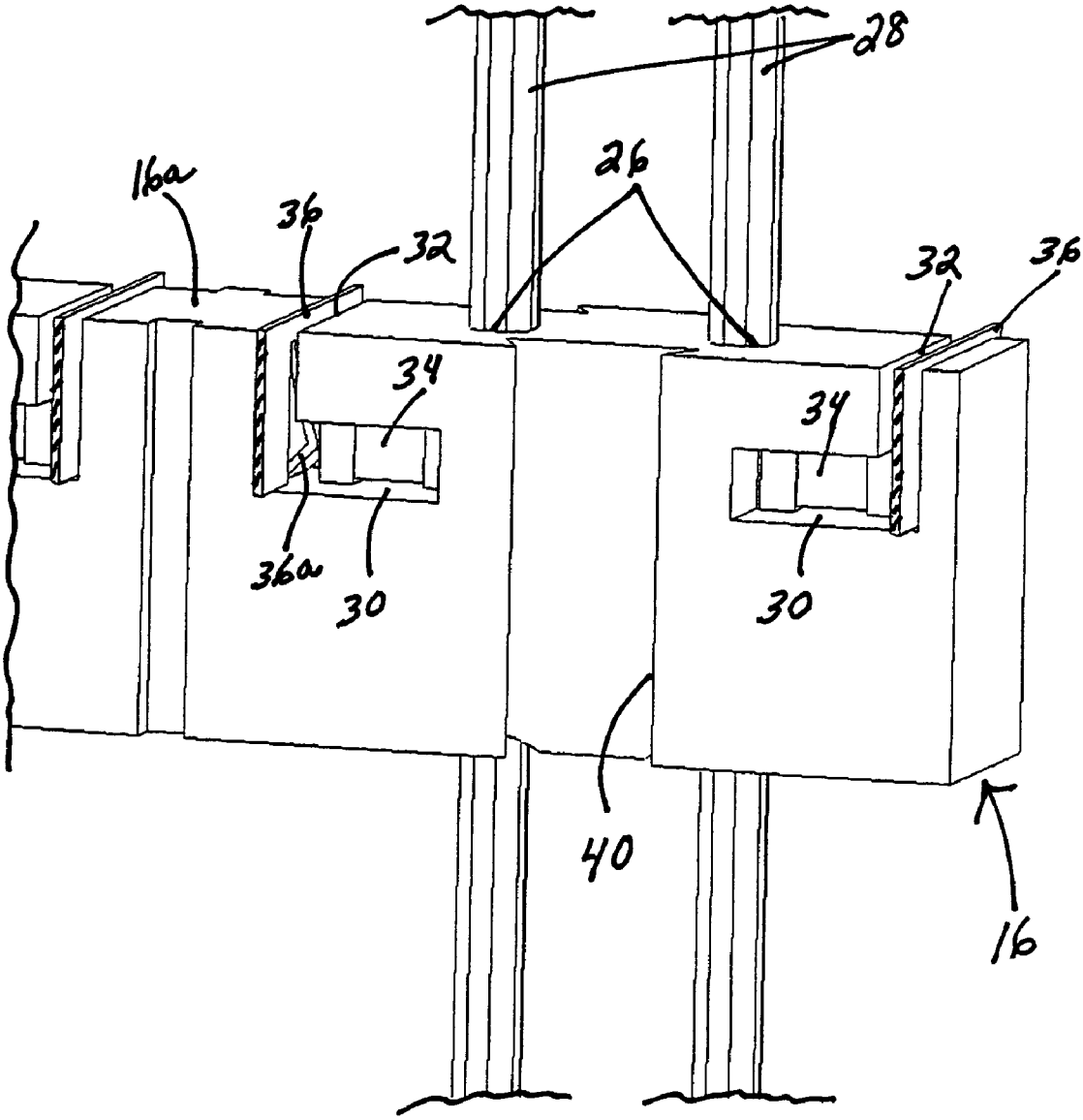
FIG. 5 is a fragmented, enlarged perspective view of the right-hand end of the module in FIG. 4.
Figure 6:
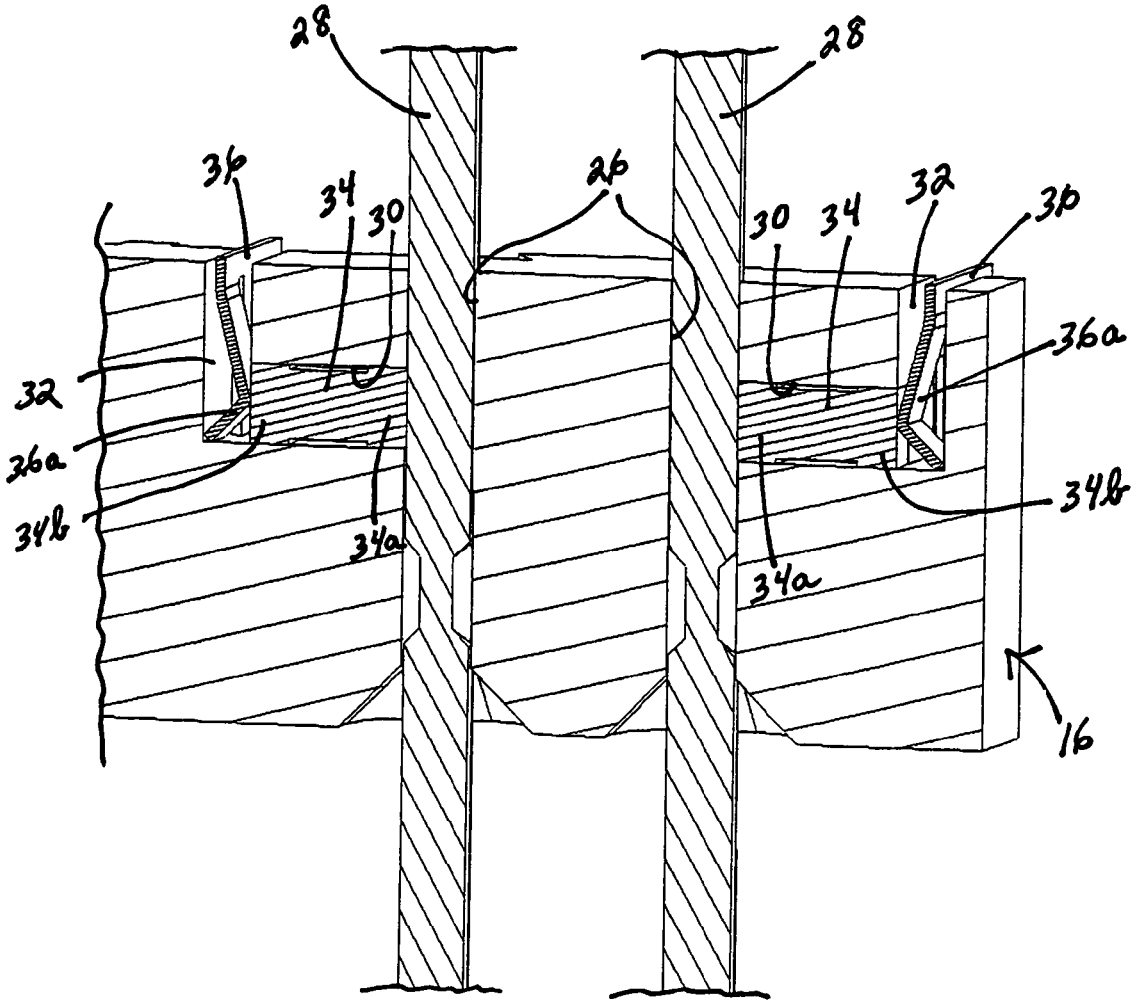
FIG. 6 is a vertical section through the fragmented portion of the module as shown in FIG. 5.

FIGS. 5 and 6 show quite clearly the assembly of one of the inner housing modules 16 with a pair of terminal pins 28, a corresponding pair of capacitors 34 and longitudinal sections of a pair of shorting bars 36. The terminal pins have been inserted through terminal-receiving passages 26 in the housing module. Capacitors 34 have been inserted into pockets 30 in the housing module in a direction generally perpendicular to the terminals and terminal-receiving passages. Shorting bars 36 have been inserted into slots 32 in the housing module. It can be seen that one end 34*a* of each capacitor 34 is in engagement with a respective one of the terminal pins 28. An opposite end 34*b* of each capacitor is in engagement with a portion of a respective one of the shorting bars 36.

Generally, biasing means are provided between shorting bars 36 and capacitors 34 to bias the capacitors against terminal pins 28. Specifically, each shorting bar may be stamped and formed of sheet metal material. As best seen in FIG. 6, an integral leaf spring portion 36*a* is stamped and formed out of each shorting bar 36 for engaging end 34*b* of each capacitor 34. This leaf spring portion biases end 34*a* of the respective capacitor into engagement with the respective terminal pin 28.

In assembly, it is contemplated that pockets 30 for receiving capacitors 34 can be dimensioned to receive the capacitors sufficiently loose to allow for easy assembly of the capacitors into their respective pockets. Then, when shorting bars 36 are inserted into slots 32, integral leaf spring portions 36*a* are effective to "tighten" the assembly by forcing the capacitors securely against the terminal pins. In other words, the shorting bars, with their leaf spring portions, are effective to hold the assembly in electrical contact.

Figure 7:
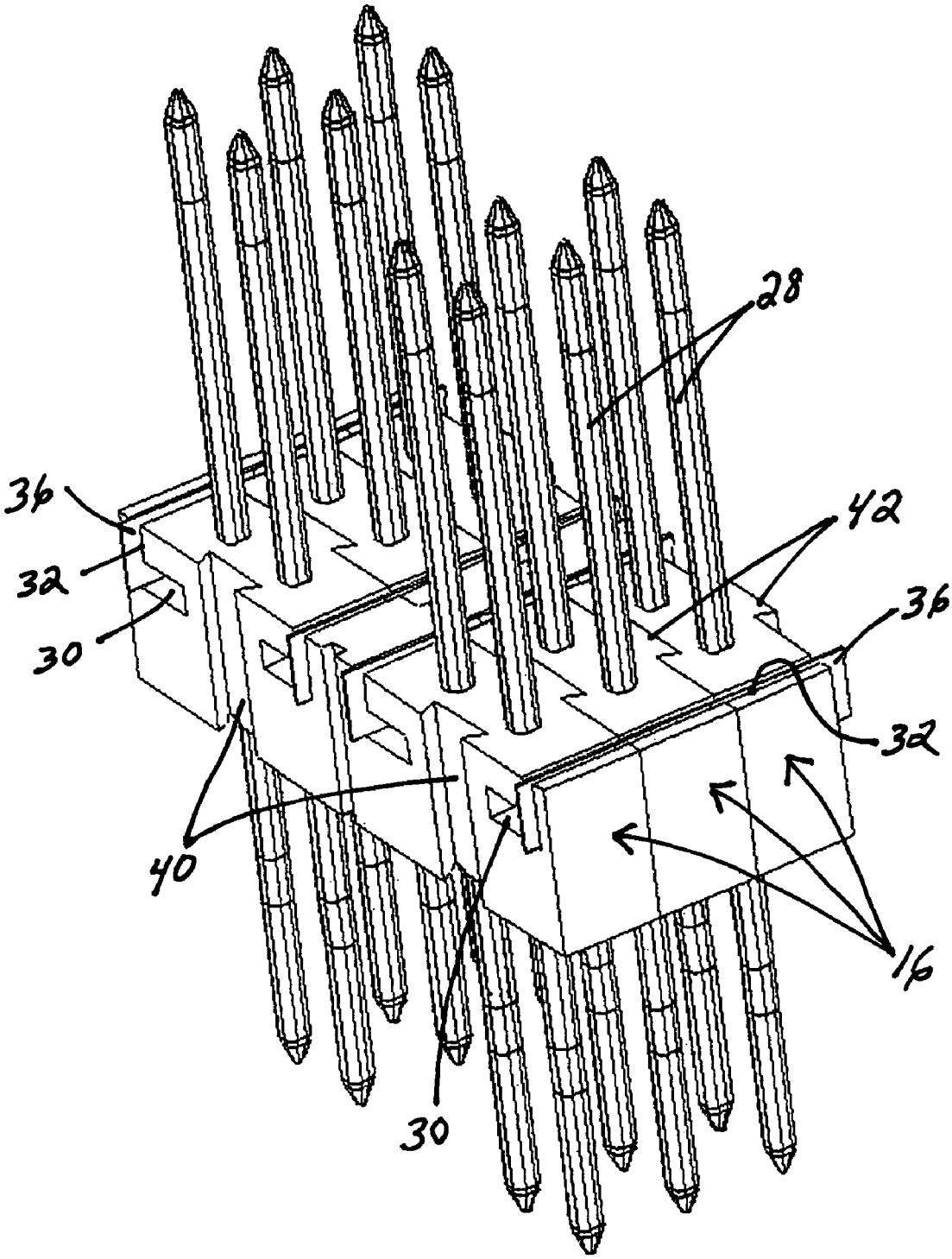
FIG. 7 is a perspective view of a cluster of three modules interconnected in a side-by-side array.

Generally, securing means are provided between adjacent housing modules 16 to hold the modules in their side-by-side array. As disclosed herein, the securing means comprise interengageable dovetail connections which are integral with the housing modules. Referring to FIG. 7, it can be seen that each housing module 16 has a pair of dovetail grooves 40 molded in one side face thereof. A pair of dovetail ribs 42 are formed on the opposite side of each module. Therefore, the modules can be secured together in a side-by-side array as shown in FIG. 7 by interengaging the dovetail-shaped ribs 42 within the dovetail-shaped grooves 40.

In assembly of connectors 10, it first is determined how many housing modules 16 are required within cavity 14 of connector housing 12. Then, each housing module is assembled with its four terminal pins 28 and four capacitors 34. The number of housing modules 16 required to fill cavity 14 then are secured together in a side-by-side array by interengaging the dovetail-shaped grooves 40 and ribs 42. Four common shorting bars 36 then are inserted into their respective slots 32 in the housing modules to hold the entire array of modules in a tight assembly, biasing capacitors 34 of the entire array against all of the terminal pins 28. This subassembly of all of the required housing modules then is inserted into cavity 14 of housing 12 as shown in FIG. 1. It can be seen that shorting bars 36 have been cut to lengths to extend beyond the end-most housing modules 16 so that the ends of the shorting bars project through slots 22 (see FIG. 2) at opposite ends of plug portion 18 of the housing. The opposite ends of the shorting bars are serrated or somehow sharpened so that they bite into the material of the metal casing that is inserted into peripheral groove 20 of the housing. Therefore, the shorting bars are grounded to the metal casing.

After the connector is fully assembled, a liquid encapsulant is poured into a recessed area 50 (FIG. 1) inside plug portion 18 of the housing. The encapsulant is cured or hardened and seals the entire outer interface of the interengaged housing modules. In addition, the encapsulent secures all components with respect to one another to maintain mechanical and electrical connections throughout its life.

With the above unique modular concept, it can be understood that connector 10 can be customized for different numbers of terminals (i.e., different densities for the connector). This is accomplished simply by changing the tooling to enlarge or reduce the length of housing 12 and, thereby, the longitudinal size of cavity 14. Changing the length of the outer housing is a relatively simple procedure. Of course, changing the length of the housing/cavity, changes the number of modules 16 which are inserted into the cavity. However, the modules, themselves, are not changed at all. Customizing the connector simply involves different numbers of modules to be inserted into the cavity of connector housing 12. This unique structural combination and method of fabrication is infinitely less complicated and less expensive than if an entire electrical connector, including means for receiving the terminal pins, means for receiving the capacitors and means for receiving the shorting bars, had to be changed for each customized connector. The manufacturing and assembly tooling would have to be changed for each and every custom connector.

Finally, although the above description in relation to the drawings describe a connector assembly wherein modules 16 form four rows of terminal pins, along with a corresponding four rows of capacitors and four shorting bars, it should be understood that this specific assembly or connector configuration is for providing a clear and concise understanding of the invention. Different numbers of rows of terminals, rows of capacitors and shorting bars are contemplated and can be easily accommodated by the invention. A single row or more than four rows could be used in a connector assembly taking advantage of the unique concepts of the invention.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A modular filter connector, comprising:

an outer housing having a cavity;

a plurality of inner housing modules positionable in the cavity of the housing in a side-by-side array;

at least one terminal mounted in each housing module to define at least one row of terminals along the cavity;

a filter mounted in each housing module electrically coupled to each terminal to define at least one row of filters; and a common shorting bar spanning the plurality of housing modules and electrically coupled to the plurality of filters of the modules.

2. The modular filter connector of claim 1 wherein said terminals comprise terminal pins.

3. The modular filter connector of claim 1 wherein said filters comprise capacitors.

4. The modular filter connector of claim 1, including biasing means between the shorting bar and the filters to bias the filters against the terminals.

5. The modular filter connector of claim 4 wherein said biasing means are integral with the shorting bar.

6. The modular filter connector of claim 5 wherein said shorting bar is stamped and formed of sheet metal material, and said biasing means comprise an integral leaf spring portion of the bar engageable with each filter.

7. The modular filter connector of claim 1, including securing means between adjacent housing modules to hold the modules in said side-by-side array.

8. The modular filter connector of claim 7 wherein said securing means comprise integral interconnecting means between adjacent housing modules.

9. The modular filter connector of claim 8 wherein said integral interconnecting means comprise interengageable dovetail connections on the housing modules.

10. The modular filter connector of claim 1, including a plurality of said terminals mounted in each housing module to define a plurality of generally parallel rows of terminals along the cavity, a corresponding plurality of generally parallel rows of said filters respectively electrically coupled to the terminals, and one of said common shorting bars spanning the housing modules electrically coupled to the filters in each row thereof.

11. A modular filter connector, comprising:

an outer housing having a cavity;

a plurality of inner housing modules positionable in the cavity of the housing in a side-by-side array;

a plurality of terminal pins mounted in each housing module to define a plurality of rows of terminal pins along the cavity;

a plurality of capacitors mounted in each housing module electrically coupled to the terminals to define a corresponding plurality of rows of capacitors; and a plurality of common shorting bars spanning the plurality of housing modules and electrically coupled to the plurality of capacitors in the respective rows thereof.

12. The modular filter connector of claim 11, including biasing means between the shorting bars and the capacitors to bias the capacitors against the terminal pins.

13. The modular filter connector of claim 12 wherein said biasing means are integral with the shorting bars.

14. The modular filter connector of claim 13 wherein said shorting bars are stamped and formed of sheet metal material, and said biasing means comprise integral leaf spring portions of the bars engageable with the capacitors.

15. The modular filter connector of claim 11, including securing means between adjacent housing modules to hold the modules in said side-by-side array.

16. The modular filter connector of claim 15 wherein said securing means comprise integral interconnecting means between adjacent housing modules.

17. The modular filter connector of claim 16 wherein said integral interconnecting means comprise interengageable dovetail connections on the housing modules.

18. A method of fabricating a modular filter connector, comprising:

providing an outer housing with a cavity;

providing a plurality of inner housing modules positionable in the cavity in a side-by-side array;

mounting at least one terminal in each housing module to define at least one row of terminals along the cavity;

mounting a filter in each housing module electrically coupled to each terminal to define at least one row of filters;

mounting a common shorting bar spanning the plurality of housing modules and electrically coupled to the plurality of filters of the modules; and assembling the plurality of inner housing modules along with their terminals and filters and the common shorting bar into the cavity of the outer housing.

19. The method of claim 18 wherein said terminals are provided as terminal pins.

20. The method of claim 18 wherein said filters are provided as capacitors.

21. The method of claim 18, including mounting a plurality of said terminals (28) in each housing module (16) to define a plurality of generally parallel rows of terminals to extend along the cavity, mounting a plurality of filters (34) respectively coupled to the terminals, and mounting one of said common shorting bars (36) spanning the housing modules and coupled to the filters in each row thereof.

* * * * *